US005799804A

United States Patent [19]

Sharpe

[11] Patent Number: 5,799,804

[45] Date of Patent: Sep. 1, 1998

[54] WALL MOUNTED FIXTURE

[75] Inventor: Norton Sharpe, Los Angeles, Calif.

[73] Assignee: Franklin Brass Manufacturing Company, Rancho Dominguez, Calif.

[21] Appl. No.: 531,178

[22] Filed: Sep. 19, 1995

[51] Int. Cl.[6] ..... A47H 1/02

[52] U.S. Cl. ..... 211/105.1; 248/222.1; 248/254

[58] Field of Search ..... 211/105.1, 123; 248/251, 216.1, 222.11, 222.12, 222.13, 254, 262, 267, 264, 316.1; D6/546, 523, 524

[56] References Cited

U.S. PATENT DOCUMENTS

| | | | |
|---|---|---|---|
| 1,249,955 | 12/1917 | Hendrickson | 248/224.61 |
| 1,280,244 | 10/1918 | Kroedel | 248/251 |
| 1,838,935 | 12/1931 | Fixsen | 248/251 |
| 2,455,606 | 12/1948 | Pleiss | 248/251 |
| 4,148,454 | 4/1979 | Carlson | 248/222.11 |
| 4,979,713 | 12/1990 | Bell | 248/251 |
| 5,022,104 | 6/1991 | Miller | 248/251 |
| 5,071,099 | 12/1991 | Kuo | 248/251 |
| 5,076,523 | 12/1991 | Wang | 248/251 |

OTHER PUBLICATIONS

Franklin Brass Catalog 250, pp. 1–31, published more than one year prior to the filing date of the present application.

*Primary Examiner*—Ramon O. Ramirez
*Assistant Examiner*—Gwendolyn W. Baxter
*Attorney, Agent, or Firm*—Loeb & Loeb LLP

[57] ABSTRACT

A wall mounted fixture includes a post and a wall plate, at least one of which has, in a preferred embodiment, a tab to engage the slot of the other to resist rotation between the wall plate and post. A large central bolt securely fastens the wall plate to the post. A flange may be snap fit to cover the wall plate.

10 Claims, 3 Drawing Sheets

WALL MOUNTED FIXTURE

BACKGROUND OF THE INVENTION

1. Field of the Invention

This invention relates generally to wall mounted bathroom fixtures, and in particular, mounting brackets for supporting towel bars, towel rings, toilet paper rollers and the like.

2. Related Art

Traditionally, bathroom fixture mounting brackets comprise three pieces: a post, a flange, and a separate mounting plate. Typically, a single screw is used to connect the post to the flange, and two screws are used to mount the mounting plate to the wall. Subsequently, another screw is used to affix the post-flange combination to the mounting plate through a hole along the side of the flange. However, because of the single screw configuration, the post-flange combination often becomes loose and a towel bar or other fixture supported by the bracket will become loose as well. Furthermore, the hole in the side of the flange for the connecting screw is considered to be aesthetically unattractive.

In other existing mounting brackets, a post is welded to a mounting plate, and a flange is snap fit over the wall plate. However, the entire bracket must usually be made of readily weldable materials such as stainless steel instead of materials such as brass, which are more difficult to weld. However, brass bathroom fixtures are often considered to be more aesthetically pleasing and often have greater consumer acceptance than stainless steel bathroom fixtures.

SUMMARY OF THE DISCLOSURE

It is an object of an embodiment of the present invention to provide an improved wall mounted fixture, which obviates for practical purposes, the above mentioned limitations of traditional wall mounted fixtures.

According to a preferred embodiment of the invention, a wall mounted fixture includes a post having a slot positioned to receive a tab carried by a wall plate to resist rotation between the post and the wall plate. The post may be readily secured directly to the wall plate by a screw and the post-wall plate assembly may then be fastened to the wall, preferably by screws. A flange is adapted to be snap fit over the wall plate. Such an arrangement has been found to substantially reduce or eliminate loosening of the post during use. In addition, the need for an unsightly screw and screw hole in the flange is eliminated. Still further, because the need for welding is eliminated, a variety of materials including brass may be readily utilized. Furthermore, the parts constituting a fixture in accordance with a preferred embodiment of the present invention are simple in construction, economical to manufacture, and are easily assembled without the use of special tools.

BRIEF DESCRIPTION OF THE DRAWINGS

Other features and advantages of the invention will become apparent from the following detailed description, taken in conjunction with the accompanying drawings which illustrate, by way of example, the various features of embodiments of the invention, and in which:

FIG. 7(*b*) is a top plan view of the flange of FIG. 7(*a*);

DETAILED DESCRIPTION OF THE PREFERRED EMBODIMENTS

Figure 1:
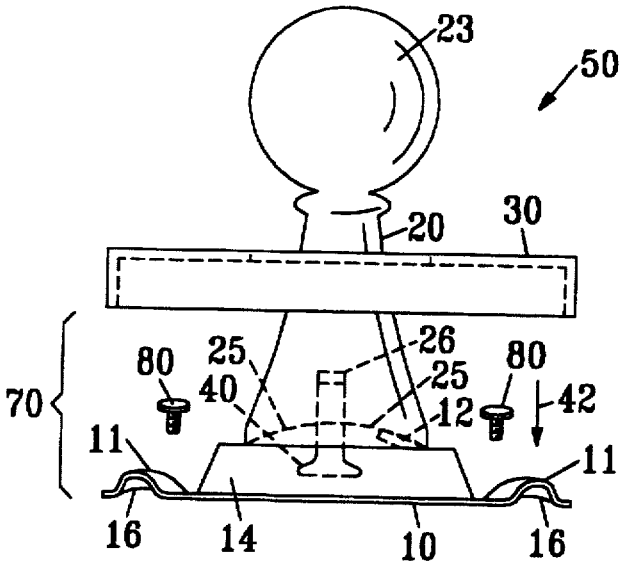
FIG. 1 is a side, partially assembled view of a wall plate, post, and flange in accordance with one embodiment of the present invention.

A towel bar mounting bracket in accordance with a preferred embodiment of the present invention is shown in the drawings for purposes of illustration. However, it should be recognized that further embodiments of the invention may be used in other applications, such as bathroom fixtures including towel ring mounting brackets, toilet paper roller mounting brackets, robe hooks, soap dishes, toothbrush and tumbler holders, and grab bars.

Figure 2:
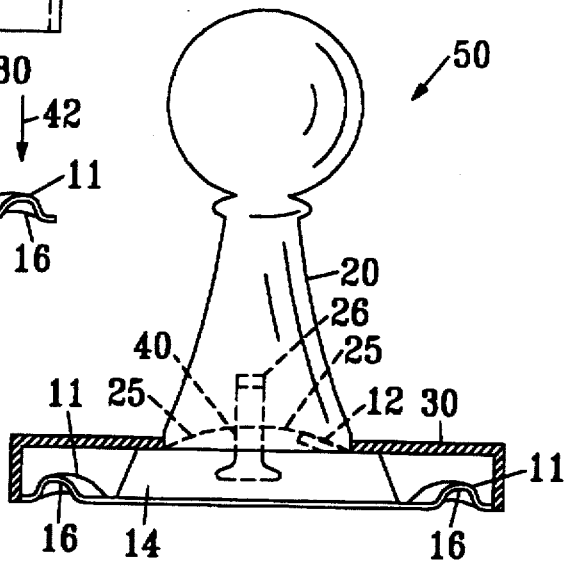
FIG. 2 is front, cross-sectional view of the embodiment of FIG. 1, shown in its assembled configuration.
Figure 9:
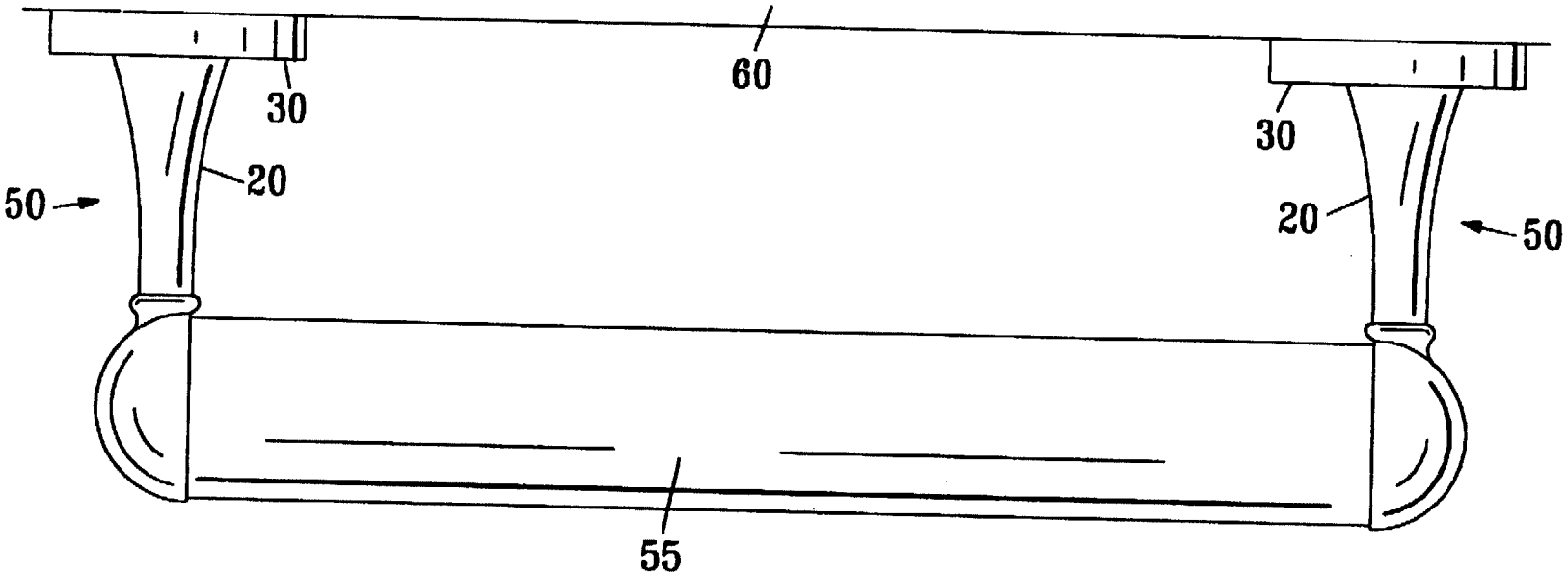
FIG. 9 is a top plan view of a towel bar bathroom fixture incorporating structures in accordance with of the present invention.

FIGS. 1, 2, and 9 show an embodiment of a towel bar mounting bracket 50 in accordance with the present invention employed to support a conventional towel bar 55. The towel bar mounting bracket 50 is comprised of three parts: a wall plate 10, a post 20, and a flange 30. As shown in FIG. 9, a combination of two mounting brackets 50 is mounted to a wall 60 with a towel bar 55 supported therebetween by the brackets 50. Each end of the towel bar 55 is received by a cavity 22 formed in the head 23 of each post 20.

Figure 3:
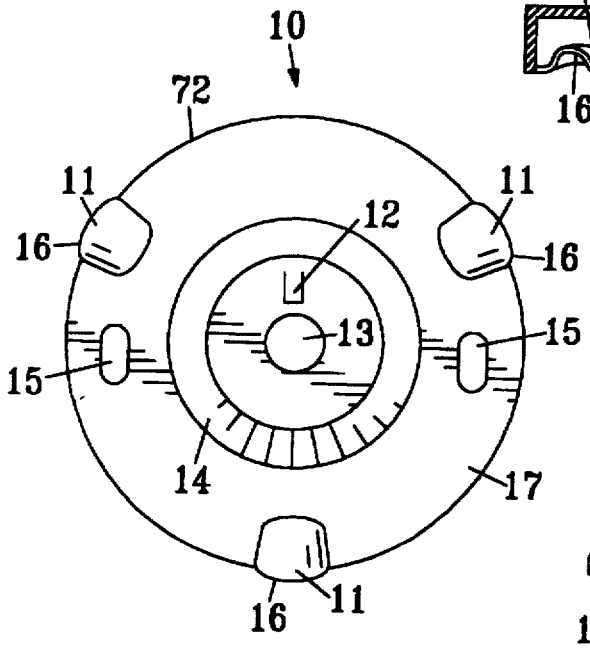
FIG. 3 is a top plan view of the wall plate of FIG. 1.
Figure 4:
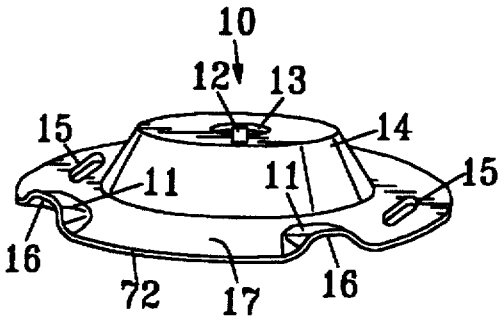
FIG. 4 is a perspective view of the wall plate of FIG. 3.
Figure 5:
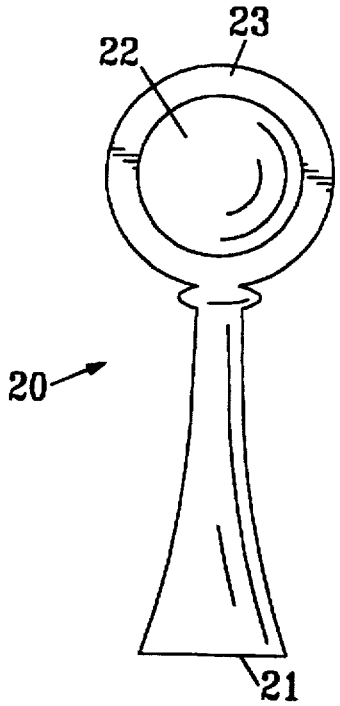
FIG. 5 is an interior side view of the post of FIG. 1.
Figure 6:
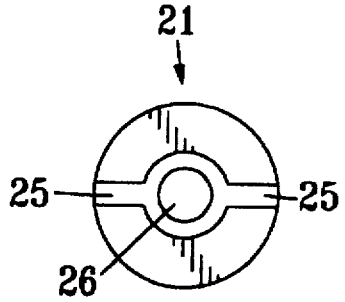
FIG. 6 is a bottom view of the post of FIG. 5.

As best seen in FIGS. 3 and 4, the wall plate 10 has a raised, generally frusto-conical center portion 14 and an annular shaped rim portion 17 extending from the raised center portion 14. Cut from the center portion 14 and bent upwards is a tab 12 which projects (FIG. 1) at an angle of approximately 30° from the surface of the center portion 14. The tab 12 of the wall plate 10 is received (FIG. 1) in one of two radially oriented slots 25 (FIG. 6) formed in the base 21 of the post 20. As best seen in FIGS. 1 and 2, the slots 25 are angled to conform generally to the projection angle of the tab 12.

The wall plate 10 is secured to the base 21 of the post 20 by means of a screw or bolt 40 which passes through a central aperture 13 (FIG. 3) of the wall plate 10 and is received by a threaded bore 26 centered in the base 21 of the post 20 to form a post-plate subassembly 70 as indicated in FIG. 1. The outer rim portion 17 of the wall plate 10 has two diametrically opposed mounting apertures 15 which are oriented orthogonally with respect to the radial position of the tab 12 of the central portion 14. The post-plate subassembly 70 may be securely mounted to the wall 60 by means of screws 80 passing through the apertures 15 into the wall 60.

Figure 7A:
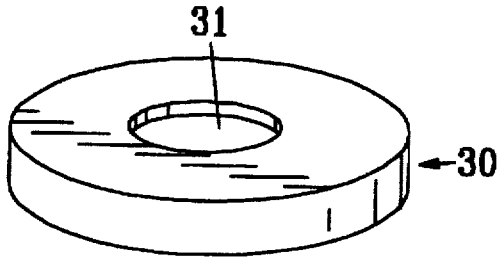
FIG. 7(*a*) is a perspective view of the flange of FIG. 1.
Figure 7B:
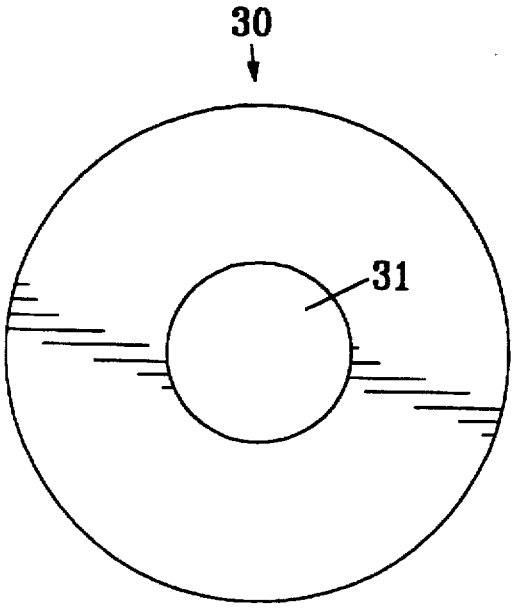

The outer rim portion 17 of the wall plate 10 further has three equally spaced dimples 11, each of which has a projecting tooth 16 that projects slightly beyond the circumference defined by the outer edge 72 of the rim portion 17. With the post-plate subassembly 70 mounted on the wall, the flange 30 may be easily snap fit over the post 20 and wall plate 10. As shown in FIGS. 7A and 7B, the flange 30 has a central aperture 31 which receives the post 20 (FIG. 1) and engages the center portion 14 (FIG. 2) of the wall plate 10 at the base 21 of the post 20, thereby hiding the wall plate 10 from view. The projecting teeth 16 of the wall plate 10 frictionally engage the inside wall of the flange 30, thereby holding the flange 30 in place.

The use of a bolt 40 to secure the wall plate 10 to the post 20 provides a very secure connection. Because the bolt 40 is completely hidden from view, the bolt can be relatively large in size, preferably on the order of ¼ inch in diameter, such that the bracket 50 is able to support relatively large loads. In addition, the tab 12 of the wall plate 10 and the mating slots 25 of the base 21 of the post 20 inhibit rotation between the wall plate 10 and the post 20, thereby further inhibiting loosening of the post 20. Still further, the interior bolt 40 used in combination with the mating tab and slot arrangement eliminates the need for an unsightly exterior screw to mount the flange to the wall plate.

Preferably, the post 20 and the flange 30 are made of attractive materials such as brass. However, since the wall plate 10 will not be visible once the towel bar bracket 50 is mounted, the wall plate 10 can be made of cheaper, yet stronger steel or other materials such as stainless steel.

Figure 8:
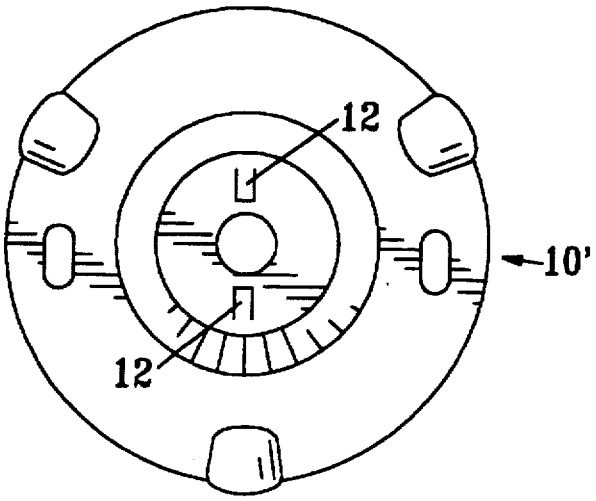
FIG. 8 is a top plan view of another embodiment of a wall plate in accordance with the present invention.

In another embodiment, shown in FIG. 8, there is provided a wall plate 10' having two, diametrically opposed tabs 12. Since the base 21 of the post 20 already has two slots, the wall plate 10' shown in FIG. 8 is interchangeable with the wall plate 10 shown in FIG. 3.

While the description above refers to particular embodiments of the present invention, it should be understood that many modifications may be made without departing from the spirit thereof. For example, projections other than tabs such as dimples or ridges may be used and apertures other than slots may be used. In addition, the tabs or other projections may be carried on the base of the post and the slots or other apertures may be defined by the wall plate. Other types of fasteners may be substituted for the central interior bolt 40 and other types of frictional members or other types of fasteners may be substituted for the dimples. Thus, the accompanying claims are intended to cover these and other modifications as would fall within the true scope and spirit of the present invention.

The presently disclosed embodiments are therefore to be considered in all respects as illustrative and not restrictive. The scope of the invention is therefore indicated by the appended claims, rather than the foregoing description, and all changes which come within the meaning and range of equivalency of the claims are therefore intended to be embraced therein.

What is claimed is:

1. A bathroom fixture mounting apparatus, comprising:

a post having a threaded bore and an aperture;

a wall plate having a projection positioned to receive the post aperture;

a screw for fastening the wall plate to the post; and a flange for covering the wall plate, wherein the post aperture is positioned to receive the wall plate projection when the wall plate is fastened to the post to prevent rotation between the wall plate and the post.

2. The apparatus of claim 1 wherein one of the flange and the wall plate has a projection which engages the other when the flange covers the wall plate wherein the flange is snap fit fastened to the wall plate.

3. A mounting bracket for a bathroom fixture, comprising:

a screw;

a wall plate with a raised center portion, the raised center portion having a tab and a center hole to receive the screw; and a post having a slot to receive the wall plate tab and a threaded bore to receive the screw.

4. A mounting bracket according to claim 3, further comprising a flange, wherein the wall plate has projections to engage the flange frictionally to snap fit the flange over the wall plate.

5. A bathroom fixture to be mounted on a wall, comprising:

a towel bar;

a circular wall plate wherein the wall plate includes two elongated screw holes directly opposite each other near the circumference of the wall plate, dimples projecting from the circumference of the wall plate, and a raised circular center, the raised circular center defining a tab and a center hole;

a post having a base which includes a slot to receive the wall plate tab, and a longitudinal threaded bore, said post further having a head which defines a cavity to receive the towel bar;

a screw passing through the center hole of the raised circular center of the wall plate and threaded into the longitudinal threaded bore at the base of the post;

first and second wall screws, each wall screw passing through the elongated screw holes of the wall plate to mount the wall plate to the wall; and a flange engaging the dimples of the wall plate to frictionally secure the flange to the wall plate.

6. A bathroom fixture mounting apparatus, comprising:

a post having a first end and a second end opposite the post first end;

a wall plate;

a fastener for fastening the wall plate to the post second end; and a flange for covering the wall plate when fastened to the post second end, said flange having a central aperture of sufficient size to permit the post first end to pass through the flange central aperture as the flange is positioned to cover the wall plate.

7. A method of mounting a bathroom fixture to a wall, comprising:

bolting a wall plate to one end of a post having first and second ends;

fastening the wall plate to the wall with the bolted post extending from the wall plate;

passing a central aperture of a flange over the other end of the post; and covering the wall plate with the flange.

8. A method of mounting a bathroom fixture to a wall, comprising:

bolting a wall plate to one end of a post having first and second ends;

fastening the wall plate to the wall with the bolted post extending from the wall plate;

passing a central aperture of a flange over the other end of the post; and covering the wall plate with the flange, wherein said bolting comprises receiving a projection from the wall plate in an aperture in the post to prevent rotation of the wall plate relative to the post as the wall plate is bolted to the wall plate.

9. The method of claim 7 wherein said bolting comprises:

extending the threaded body of a bolt having a head and a threaded body through an aperture in the wall plate so that the bolt head is on one side of the wall plate and the bolt threaded body is on the other side of the wall plate; and threading the bolt threaded body into a threaded bore in the post;

wherein said wall plate fastening comprises placing the bolt head side of the wall plate against the wall and screwing the wall plate to the wall.

10. A method of mounting a bathroom fixture to a wall, comprising:

bolting a wall plate to one end of a post having first and second ends:

fastening the wall plate to the wall with the bolted post extending from the wall plate;

passing a central aperture of a flange over the other end of the post; and covering the wall plate with the flange, wherein said wall plate covering comprises snap fitting the flange over the wall plate.

* * * * *